US008281854B2

(12) United States Patent
Gaudette et al.

(10) Patent No.: US 8,281,854 B2
(45) Date of Patent: Oct. 9, 2012

(54) CONNECTOR FOR MOUNTING SCREEN TO BASE PIPE WITHOUT WELDING OR SWAGING

(75) Inventors: Sean L. Gaudette, Katy, TX (US); Jason J. Barnard, Katy, TX (US); Gerald D. Lynde, Houston, TX (US); Omar H. Balcazar, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 305 days.

(21) Appl. No.: 12/689,820

(22) Filed: Jan. 19, 2010

(65) Prior Publication Data

US 2011/0174481 A1 Jul. 21, 2011

(51) Int. Cl.
*E21B 43/08* (2006.01)

(52) U.S. Cl. ..... 166/227; 166/242.6; 166/278

(58) Field of Classification Search ..... 166/278, 166/380, 382, 227, 242.6
See application file for complete search history.

(56) References Cited

U.S. PATENT DOCUMENTS

| | | | | |
|---|---|---|---|---|
| 2,201,433 | A * | 5/1940 | Ford | 166/208 |
| 2,981,332 | A | 4/1961 | Miller et al. | |
| 2,981,333 | A | 4/1961 | Miller et al. | |
| 4,262,744 | A | 4/1981 | Mitchell et al. | |
| 4,284,138 | A * | 8/1981 | Allred | 166/233 |
| 5,318,119 | A * | 6/1994 | Lowry et al. | 166/228 |
| 5,509,483 | A * | 4/1996 | Graen | 166/382 |
| 5,611,399 | A * | 3/1997 | Richard et al. | 166/230 |
| 5,667,011 | A | 9/1997 | Gill et al. | |
| 5,833,001 | A | 11/1998 | Song et al. | |
| 5,842,522 | A * | 12/1998 | Echols et al. | 166/378 |
| 5,881,812 | A * | 3/1999 | Malbrel et al. | 166/278 |
| 5,901,789 | A | 5/1999 | Donnelly et al. | |
| 5,931,232 | A | 8/1999 | Echols et al. | |
| 5,992,518 | A * | 11/1999 | Whitlock | 166/235 |
| 6,012,522 | A | 1/2000 | Donnelly et al. | |
| 6,062,307 | A | 5/2000 | Hamid et al. | |
| 6,253,850 | B1 | 7/2001 | Nazzai et al. | |

(Continued)

FOREIGN PATENT DOCUMENTS

WO WO 2008062178 A1 * 5/2008

OTHER PUBLICATIONS

Downhole Products Ltd, Edinburgh Scotland; http://www.downhole.org/products.html, Jan. 19, 2010.

(Continued)

*Primary Examiner* — Jennifer H Gay
(74) *Attorney, Agent, or Firm* — Steve Rosenblatt

(57) ABSTRACT

A subterranean screen system features openings in a base pipe and sleeve sections of a porous material that preferably swells in the borehole to span an annular space around the base pipe. Retainers are mounted to the base pipe in a desired location and mechanically fixated using an internal grip system actuated through the wall of the retainer. A wedging action of slip segments is initiated by an angularly advancing assembly through the wall of the retainer. The retainer can have end rings extending past one or both ends over which the screen sleeve extends. Flat or ridges on the exterior of the retainer or end rings make assembly easier with hand tools to allow for rapid field assembly, if needed. Filtration occurs through the sleeves that abut the borehole wall and into the base pipe openings and to the surface.

19 Claims, 2 Drawing Sheets

U.S. PATENT DOCUMENTS

| | | | | |
|---|---|---|---|---|
| 6,263,966 | B1 | 7/2001 | Haut et al. | |
| 6,530,431 | B1 | 3/2003 | Castano-Mears et al. | |
| 6,776,241 | B2 * | 8/2004 | Castano-Mears et al. | 166/381 |
| 7,013,979 | B2 | 3/2006 | Richard | |
| 7,140,446 | B2 * | 11/2006 | Metcalfe | 166/380 |
| 7,318,481 | B2 | 1/2008 | Richard | |
| 7,387,158 | B2 | 6/2008 | Murray et al. | |
| 7,441,596 | B2 | 10/2008 | Wood et al. | |
| 7,552,767 | B2 | 6/2009 | Wood | |
| 7,784,550 | B2 * | 8/2010 | Nutley et al. | 166/378 |
| 7,793,716 | B2 * | 9/2010 | Macias et al. | 166/236 |
| 7,854,257 | B2 * | 12/2010 | Broome et al. | 166/56 |
| 7,896,085 | B2 * | 3/2011 | Nutley et al. | 166/380 |
| 2003/0056959 | A1 * | 3/2003 | Castano-Mears et al. | 166/384 |
| 2004/0194968 | A1 * | 10/2004 | Metcalfe | 166/380 |
| 2004/0221984 | A1 * | 11/2004 | Cram | 166/227 |
| 2005/0199385 | A1 * | 9/2005 | Metcalfe | 166/206 |
| 2008/0196879 | A1 | 8/2008 | Broome et al. | |
| 2009/0272541 | A1 * | 11/2009 | Nutley et al. | 166/378 |
| 2009/0277648 | A1 * | 11/2009 | Nutley et al. | 166/382 |
| 2011/0036565 | A1 * | 2/2011 | Holderman et al. | 166/227 |
| 2011/0174481 | A1 * | 7/2011 | Gaudette et al. | 166/227 |

OTHER PUBLICATIONS

Williford, J., et al., "Expandable Liner Hanger Resolves Sealing Problems and Improves Integrity in Liner Completion Scenarios", SPE 106757, Mar. 2007, 1-9.

Wardak, Ajmal, et al., "Expandable Liner Hanger System Enhances Liner Installations by Providing Viable Solutions That Overcome Deployment and Installation Issues in Low Pressure Reservoirs", SPE 117049, Mar. 2008, 1-9.

Lee, Seung Kook, et al., "Lessons Learned from Highly Deviated Openhole Completions in Two HP/HT Retrograde Gas-Condensate Fields Using Expandable Liner Hangers, External-Sleeve Inflatable Packer Collars, and Swellable Packers for Zonal Isolation", IADC/SPE 114789, Aug. 2008, 1-19.

* cited by examiner

CONNECTOR FOR MOUNTING SCREEN TO BASE PIPE WITHOUT WELDING OR SWAGING

FIELD OF THE INVENTION

The field of this invention is downhole screens and more particularly those that are porous and swell in open hole to close off an irregularly shaped borehole and most particularly fixation devices to secure sleeves of such material to a base pipe with openings.

BACKGROUND OF THE INVENTION

In the past sand control methods have been dominated by gravel packing outside of downhole screens. The idea was to fill the annular space outside the screen with sand to prevent the production of undesirable solids from the formation. More recently, with the advent of tubular expansion technology, it was thought that the need for gravel packing could be eliminated if a screen or screens could be expanded in place to eliminate the surrounding annular space that had heretofore been packed with sand. Problems arose with the screen expansion technique as a replacement for gravel packing because of wellbore shape irregularities. A fixed swage would expand a screen a fixed amount. The problems were that a washout in the wellbore would still leave a large annular space outside the screen. Conversely, a tight spot in the wellbore could create the risk of sticking the fixed swage.

One improvement of the fixed swage technique was to use various forms of flexible swages. In theory these flexible swages were compliant so that in a tight spot they would flex inwardly and reduce the chance of sticking the swage. On the other hand, if there was a void area, the same problem persisted in that the flexible swage had a finite outer dimension to which it would expand the screen. Therefore, the use of flexible swages still left the problem of annular gaps outside the screen with a resulting undesired production of solids when the well was put on production from that zone.

Prior designs of screens have used pre-compressed mat held by a metal sheath that is then subjected to a chemical attack when placed in the desired location downhole. The mat is then allowed to expand from its pre-compressed state. The screen is not expanded. This design is described in U.S. Pat. Nos. 2,981,332 and 2,981,333. U.S. Pat. No. 5,667,011 shows a fixed swage expanding a slotted liner downhole. U.S. Pat. Nos. 5,901,789 and 6,012,522 show well screens being expanded. U.S. Pat. No. 6,253,850 shows a technique of inserting one solid liner in another already expanded slotted liner to blank it off and the used of rubber or epoxies to seal between the liners. U.S. Pat. No. 6,263,966 shows a screen with longitudinal pleats being expanded downhole. U.S. Pat. No. 5,833,001 shows rubber cured in place to make a patch after being expanded with an inflatable. Finally, U.S. Pat. No. 4,262,744 is of general interest as a technique for making screens using molds.

U.S. Pat. No. 7,318,481 addresses this issue by providing a screen assembly with an outer layer that can conform to the borehole shape upon expansion. The material is selected that will swell in contact with wellbore fluids to further promote filling the void areas in the borehole after expansion. In an alternative design, screen expansion is not required and the outermost layer swells to conform to the borehole shape from contact with well fluids or other fluids introduced into the wellbore. The screen section is fabricated in a manner that reduces or eliminates welds. Welds are placed under severe loading in an expansion process, so minimizing or eliminating welds provides for more reliable screen operation after expansion.

However, the outer layer that is the screen as described is U.S. Pat. No. 7,318,481 has to make the trip into the borehole and retain its relative position to the base pipe openings that are initially under it. When placed at the desired location it still needs some longitudinal fixation to hold proper positioning relative to the base pipe below. Since such screen materials are heat sensitive, welding retainers is not suitable for this application. What is needed is a fixation device that can be quickly mounted and mechanically anchored to properly place and hold the sleeves that comprise the screen sections that are slipped over the base pipe in the assembly process. On many occasions these assemblies are field assembled so that the components need to be simply constructed so that they can be mounted with available tools at a borehole site or a district distribution location.

In other unrelated applications to swelling packers that hold large differential pressures end retaining devices for the swelling elements that seal a borehole have been used as an integral component of the sealing assembly for protection against end extrusion under high differential pressures. A few examples of such packers are U.S. Pat. Nos. 7,013,979; 7,552,767; 7,441,596 and 7,387,158. Other annularly shaped retainers for fitment on tubulars are made by Downhole Products Ltd. of Edinburgh Scotland and illustrated on their web site with a variety guide shoes and centralizers at http://www.downhole.org/products.html.

What is needed and provided by the present invention is a rapidly deployed over the tubular retainer to properly position porous sleeves used in conjunction with base pipes having openings to retain the sleeves in the desired position for the trip downhole and in service when flow through the sleeve begins. The sleeve is initially retained for the trip into the borehole and continues to be retained after it is in position and has swelled or otherwise grown to span the annular space around the base pipe to the borehole wall. Exterior flats or ridges are provided for rapid assembly using hand tools to allow for field assembly of a screen system. These and other features of the present invention will be more readily apparent to those skilled in the art from a review of the description of the preferred and alternative embodiments and the associated drawings while understanding that the full scope of the invention is determined by the appended claims.

SUMMARY OF THE INVENTION

A subterranean screen system features openings in a base pipe and sleeve sections of a porous material that preferably swells in the borehole to span an annular space around the base pipe. Retainers are mounted to the base pipe in a desired location and mechanically fixated using an internal grip system actuated through the wall of the retainer. A wedging action of slip segments is initiated by an angularly advancing assembly through the wall of the retainer. The retainer can have end rings extending past one or both ends over which the screen sleeve extends. Flat or ridges on the exterior of the retainer or end rings make assembly easier with hand tools to allow for rapid field assembly, if needed. Filtration occurs through the sleeves that abut the borehole wall and into the base pipe openings and to the surface.

DETAILED DESCRIPTION OF THE PREFERRED EMBODIMENT

Figure 1:
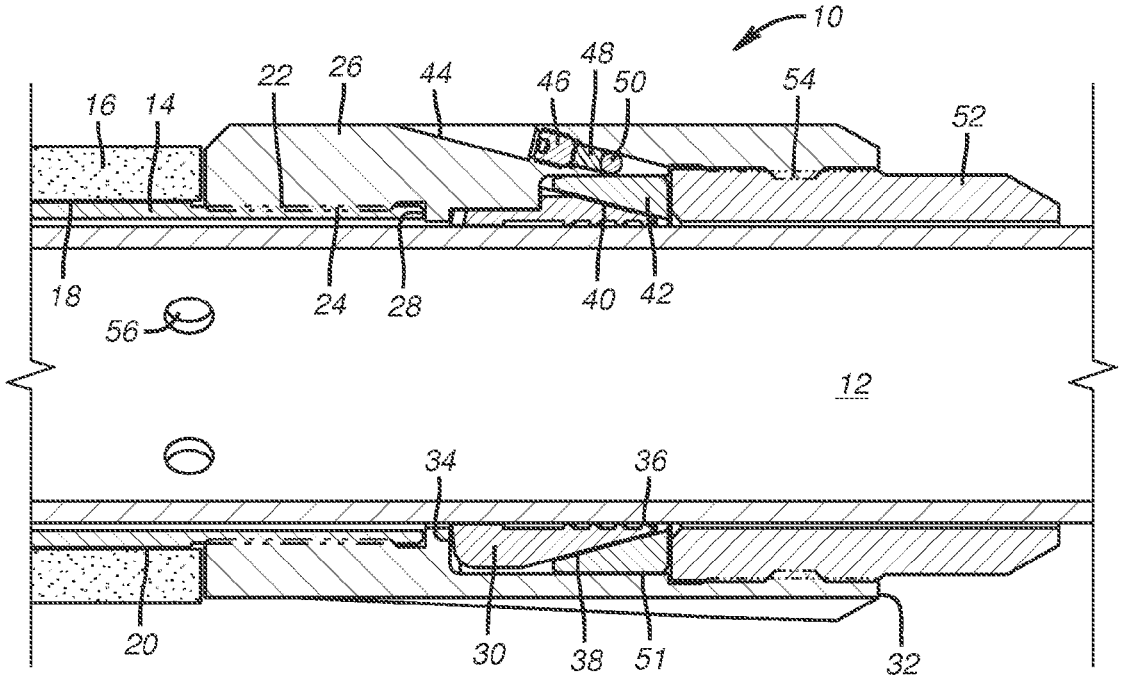
FIG. 1 is a section view of a retainer using a single end ring.
Figure 2:
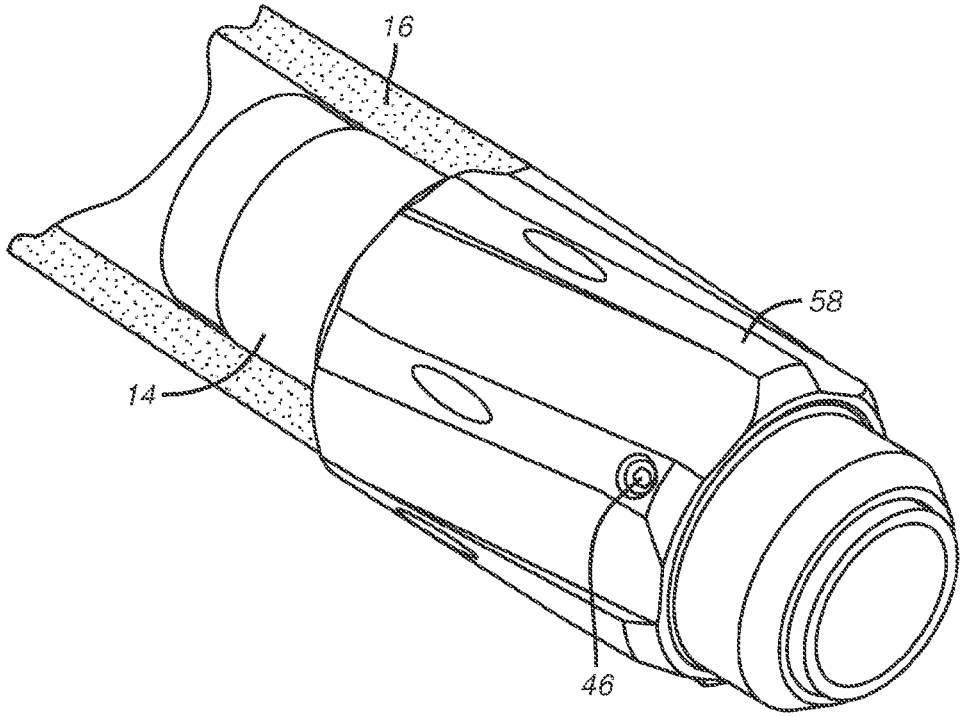
FIG. 2 is an exterior view of the retainer of FIG. 1.

FIG. 1 illustrates a single sided retainer assembly 10. It comprises a base pipe 12 over which an end ring 14 is mounted by sliding it over an end of a joint that is part of the base pipe 12. A filter element 16 is a sleeve that is porous and when in the borehole preferably enlarges to meet the borehole wall so that it presses against the borehole wall (not shown) and in the opposite direction back against the end ring 14. Initially, during assembly, the inside dimension 18 is preferably a clearance or slight interference fit to the outside surface 20 of the end ring 14. Threads 22 on the end ring 14 engage threads 24 on the anchor ring housing 26. A shoulder 28 on the housing 26 acts as a travel stop for threads 22 and 24. Segmented slips 30 are inserted through end 32 of the housing 26 when the base pipe 12 is already through the housing 26. The slip segments shoulder out against shoulder 34 with wickers 36 facing the base pipe 12. The wickers 36 can be sharp ridge whose orientation can be radial directly into the base pipe 12 or some wickers can slant in opposition to other wickers 36 to resist applied forces to the housing 26 that come from either direction. Slip segments 30 have an exterior taper 38 on which rides taper 40 of wedge ring 42. Lateral openings 44 in housing 26 are threaded to allow set screw 46 to advance a rubber member 48 and a ball 50 against surface 51 of the wedge ring 42. Retainer 52 is assembled using threads 54 to housing 26 as the last component of the assembly. Turning on the set screws 46 compresses the rubber member 48 against the ball 50 to retain the wedge ring 42 against the slip segments 30 so that the wickers 36 penetrate the wall of the base pipe 12 when ring 52 is made up to end 32. Base pipe 12 has a series of openings 56 to allow flow from the formation through the filter element 16. While FIGS. 1 and 2 show a single sided assembly with one end ring 14, those skilled in the art will appreciate that instead of retainer 52 another end ring 14 can be threaded in with another filter element 16 slipped over it so that there is a minor image assembly presented.

End rings 14 or retainers 52 can have external flats or ridges to allow tools to get a grip for rapid and secure threading of the threads 22 and 24 or the thread 54. FIG. 2 illustrates ridges 58 on the housing 26 to also facilitate grip of tools for assembly and to provide a flow channel between adjacent filter elements 16 or to a single element 16 at the end of an array of them as shown in FIG. 2.

Figure 3:
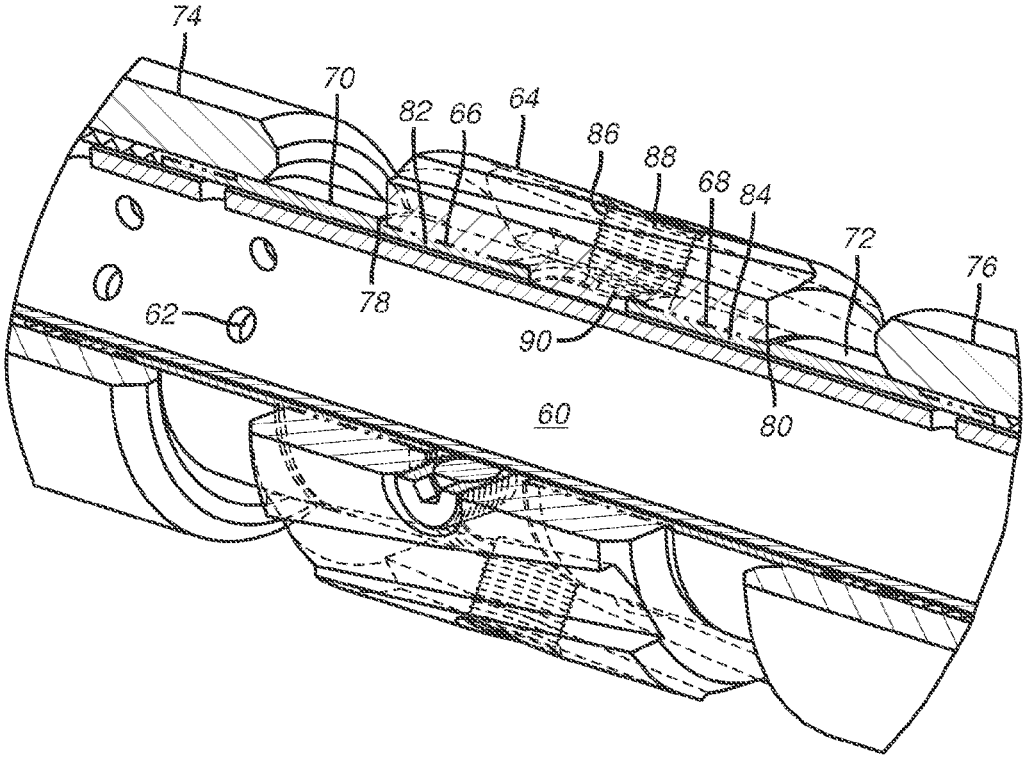
FIG. 3 is a section view of an alternative embodiment with opposed end rings.
Figure 4:
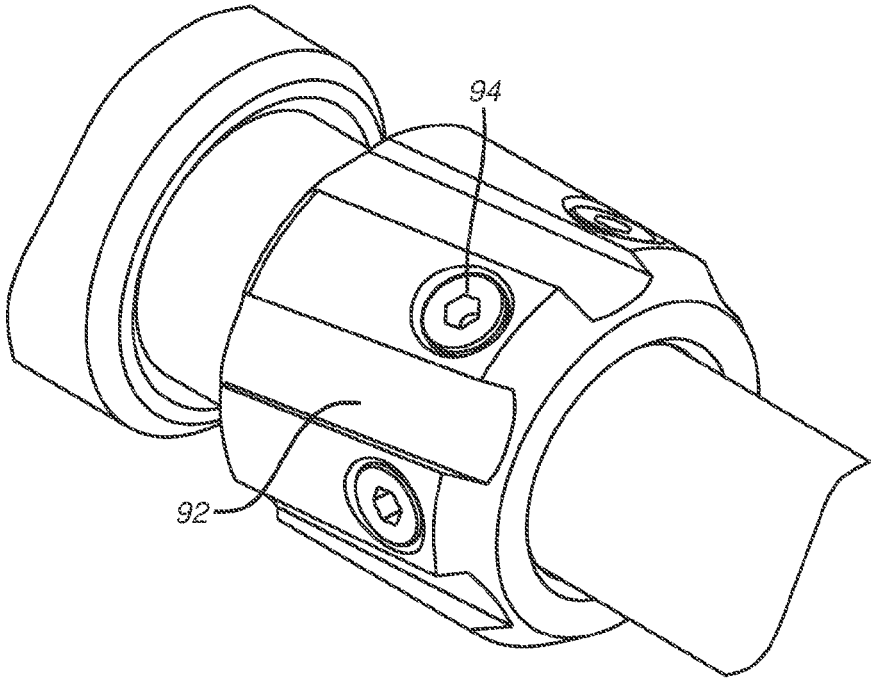
FIG. 4 is an exterior view of the retainer of FIG. 3.

FIG. 3 is an alternative embodiment showing a base pipe 60 with openings 62. It has a grip ring 64 with threads 66 and 68 at opposed ends. Shrouds or end rings 70 and 72 thread in at opposed ends to threads 66 and 68. A screen sleeve 74 and 76 fits respectively over the shrouds 70 and 72. As before the fit over the shrouds is preferably a clearance or interference fit. Shrouds 70 and 72 have grooves 78 and 80 into which inwardly extending projections 82 and 84 extend thereby holding the shrouds 70 and 72 in a fixed space relation to each other when the shrouds 70 and 72 are preassembled to the grip ring 64 before all three are slid over the base pipe 60. One or more threaded openings 86 accommodate a set screw 88 that is advanced into a gripping relationship with the external surface of the base pipe 60. The bottom 90 of each set screw 88 can have wickers or some surface roughening or other insert to facilitate grip or penetration into the base pipe 60 wall to enhance the grip. As shown in FIG. 4 one or more external grooves 92 can be provided to allow flow during run in. Shrouds 70 and 72 can have exterior flats to aid in using tools when threading those parts to the grip housing 64. Hex recesses 94 facilitate driving the set screws 88 with an Allen wrench.

Those skilled in the art will now appreciate that a screen assembly made up of individual sleeves over base pipes with openings where the sleeves are porous and preferably swell to the surrounding wellbore wall is made more reliable with fixation devices that keep the sleeves in position not only for the trip into the well but also after fluids are flowing through the screen sleeves. While swelling of the sleeves to conform to the borehole shape is desirable, a porous sleeve without such characteristics is also envisioned. The sleeve can be a foam material or a collection of intertwined elongated materials to create a porous structure that will retain solids on a given size or size range. The sleeve can be seamless or a scroll with overlapping ends or it can have a longitudinal or spiral seam. While high differential pressures are not anticipated unless there is a complete flow blockage, the retainers such as 26 or 64 help maintain the sleeves sealingly over the openings 56 or 62. The retainers make up for the column strength lacking in the filter sleeves particularly if they swell or otherwise enlarge which condition could further diminish their column strength. Alternatively, metallic screen sleeves with suitable end seals can also be retained by the retainers to a base pipe with openings. While some arrangements of fixation have been illustrated in the FIGS. it is understood that other techniques of fixation are contemplated. While slip segments are illustrate the slips can be a ring with breakable connections so that the segments are only created as set screws 46 are turned. Other fixation arrangements such as camming a dog into a window on the retainer ring 52 for example are also contemplated. What is preferred is a lock assembly that is simple, easy to deploy even at the well location and can retain grip for extended periods of time during the service life of the device.

The above description is illustrative of the preferred embodiment and many modifications may be made by those skilled in the art without departing from the invention whose scope is to be determined from the literal and equivalent scope of the claims below.

We claim:

1. A screen assembly for subterranean use in a bore defined by a wall, comprising:

a base pipe having at least one opening in a wall thereof said base pipe having an axis;

at least one annularly shaped screen segment mounted over said base pipe;

at least one retainer housing having a passage therethrough to allow said retainer housing to be slipped over said base pipe and selectively affixed to said base pipe at a predetermined location, said retainer housing preventing axial movement of said screen segment in at least one direction;

said retainer housing further comprises at least one grip assembly actuated through an opening in a wall defining said retainer housing, said opening oriented at an acute angle with respect to said axis to create a wedging action with respect to said wall of said base pipe.

2. The assembly of claim 1, wherein:

said grip assembly selectively contacts said wall defining said base pipe.

3. The assembly of claim 2, wherein:

said grip assembly applies a compressive force to said wall defining said base pipe.

4. The assembly of claim 3, wherein:

said grip assembly comprises at least one threaded set screw that is selectively advanced into said wall defining said base pipe by rotation thereof.

5. The assembly of claim 4, wherein:

said set screw is advanced radially into said wall that defines said base pipe and further comprises an end surface feature that promotes penetration into said wall defining said base pipe.

6. The assembly of claim 1, wherein:

said screen segment growing toward the wall of the bore when exposed to well fluids and taking the shape of the bore.

7. The assembly of claim 6, wherein:

said retainer housing further comprising an end ring extending past said retainer housing on at least one end of said retainer ring, said end ring mounted over said wall defining said base pipe and secured to said retainer housing;

said end ring has a said screen segment mounted over them in a clearance or interference fit.

8. The assembly of claim 7, wherein:

said grip assembly selectively contacts said wall defining said base pipe;

said grip assembly applies a compressive force to said wall defining said base pipe;

said grip assembly comprises at least one slip segment wedged into said wall defining said base pipe;

said grip assembly comprises a wedge ring having a tapered surface that rides on a tapered surface of said slip segment to cam said slip segment radially.

9. A screen assembly for subterranean use in a bore defined by a wall, comprising:

a base pipe having at least one opening in a wall thereof;

at least one annularly shaped screen segment mounted over said base pipe;

at least one retainer housing having a passage therethrough to allow said retainer housing to be slipped over said base pipe and selectively affixed to said base pipe at a predetermined location, said retainer housing preventing axial movement of said screen segment in at least one direction;

said retainer housing further comprises at least one grip assembly actuated through an opening in a wall defining said retainer housing;

said grip assembly selectively contacts said wall defining said base pipe;

said grip assembly applies a compressive force to said wall defining said base pipe;

said grip assembly comprises at least one slip segment wedged into said wall defining said base pipe.

10. The assembly of claim 9, wherein:

said grip assembly comprises a wedge ring having a tapered surface that rides on a tapered surface of said slip segment to cam said slip segment radially.

11. The assembly of claim 10, wherein:

said wedge ring is retained at least one set screw pushing on a resilient member located between said set screw and said wedge ring.

12. The assembly of claim 11, wherein:

said resilient member pushes on a grip ball that contacts said wedge ring.

13. The assembly of claim 10, wherein:

said wedge ring is retained to said retainer housing with a retainer ring;

said retainer housing further comprising an end ring extending past said retainer housing on an opposite end of said retainer housing from said retainer ring, said end ring mounted over said wall defining said base pipe and secured to said retainer housing.

14. The assembly of claim 13, wherein:

said annularly shaped screen segment fitting over said end ring in a clearance or interference fit.

15. The assembly of claim 14, wherein:

said screen segment growing toward the wall of the bore when exposed to well fluids and taking the shape of the bore.

16. The assembly of claim 10, wherein:

said wedge ring is retained to said retainer housing with a first end ring extending beyond said retainer housing;

said retainer housing further comprises a second end ring extending beyond an opposite end of said retainer housing than said first end ring;

each of said end rings have a said screen segment mounted over them in a clearance or interference fit.

17. The assembly of claim 16, wherein:

said screen segments growing toward the wall of the bore when exposed to well fluids and taking the shape of the bore.

18. A screen assembly for subterranean use in a bore defined by a wall, comprising:

a base pipe having at least one opening in a wall thereof;

at least one annularly shaped screen segment mounted over said base pipe;

at least one retainer housing having a passage therethrough to allow said retainer housing to be slipped over said base pipe and selectively affixed to said base pipe at a predetermined location, said retainer housing preventing axial movement of said screen segment in at least one direction;

said retainer housing further comprises at least one grip assembly actuated through an opening in a wall defining said retainer housing;

said grip assembly selectively contacts said wall defining said base pipe;

said grip assembly applies a compressive force to said wall defining said base pipe;

said grip assembly comprises at least one threaded set screw that is selectively advanced into said wall defining said base pipe by rotation thereof;

said retainer housing comprises a first end ring extending beyond said retainer housing;

said retainer housing further comprises a second end ring extending beyond an opposite end of said retainer housing than said first end ring;

each of said end rings have a said screen segment mounted over them in a clearance or interference fit.

19. The assembly of claim 18, wherein:

said screen segments growing toward the wall of the bore when exposed to well fluids and taking the shape of the bore.

* * * * *